United States Patent [19]

Oxendahl et al.

[11] 4,285,477

[45] Aug. 25, 1981

[54] CONSTRUCTION LINE REEL

[76] Inventors: Terrence L. Oxendahl, 1130 E. Butler B-5, Phoenix, Ariz. 85020; Allen E. Davidson, 17008 N. 49th Ave., Glendale, Ariz. 85308

[21] Appl. No.: 34,552

[22] Filed: Apr. 30, 1979

[51] Int. Cl.[3] ..... B65H 75/40

[52] U.S. Cl. ..... 242/96

[58] Field of Search ..... 242/96, 100, 84.8; 244/155 A

[56] References Cited

U.S. PATENT DOCUMENTS

| | | | |
|---|---|---|---|
| 1,579,886 | 4/1926 | Oxner | 242/96 |
| 3,885,752 | 5/1975 | Noffsinger | 242/96 |
| 3,901,458 | 8/1975 | Kuncz | 242/85.1 |

*Primary Examiner*—Edward J. McCarthy

*Attorney, Agent, or Firm*—Cahill, Sutton & Thomas

[57] ABSTRACT

A construction line reel has a cord bearing head upon which construction line is wound freely rotatably disposed on a single handle. The cord bearing head is elongated in the direction of its axis of rotation to effect safe and convenient one-handed dispensing of construction line, enabling construction workers working at unsafe heights to focus maximum attention upon their safety while dispensing construction line.

6 Claims, 8 Drawing Figures

CONSTRUCTION LINE REEL

BACKGROUND OF THE INVENTION

1. Field of the Invention

The invention relates to construction line reels, and more particularly, to construction line reels designed for safe and convenient deployment by construction workers.

2. Description of the Prior Art

Construction workers, including carpenters, masonry workers, steel workers, and the like are frequently required to use long lengths of heavy string, referred hereinafter as construction line, pulled taut between various points in order to establish straight lines. Such straight lines are necessary in order to properly align various structural members or elements during construction of a particular structure. Construction lines are utilized for almost innumerable layout and alignment tasks which must be performed during various construction tasks both at ground level and at high, dangerous portions of partially completed structures. Therefore, construction workers frequently need to dispense construction line at dangerous heights and under other dangerous working conditions which require maximum attention by the construction worker for his own safety. For example, a worker who must walk or convey himself along a high, narrow beam, or along the top of a partially completed wall section while dispensing construction line may experience considerable difficulty focusing his attention both on keeping his balance and simultaneously dispensing the construction line.

Accordingly, it is an object of the invention to provide a construction line dispensing apparatus which can be safely and conveniently deployed by a construction worker while allowing the construction worker to focus maximum attention on his own safety.

Frequently, construction line is merely wound on an elongated piece of board. It is very inconvenient to dispense construction line from such a piece of board, since two hands are required to rapidly dispense the construction line from such a board and considerable attention must be directed to the line dispensing process by a construction worker to keep the board turning about its longitudinal axis and to prevent snagging or tangling of the line, especially if the worker attempts to orient the axis of the board in the direction in which the construction line is being dispensed to pull the line off of the board sideways. Thus, a construction worker dispensing construction line from a board upon which it is wound may substantially increase the danger to himself by using such a technique.

It is therefore another object of the invention to provide a construction line dispensing apparatus which can be conveniently and easily deployed utilizing one hand only, allowing the worker to use his other hand to brace himself or otherwise attend to his safety.

Still another object of the invention is to provide a safely and conveniently deployable construction line reel which is inexpensive.

A novelty search directed to the present invention uncovered the following U.S. Pat. Nos.: 1,451; 109,318; 159,333; 542,564; 560,925; 686,456; 836,444; 850,236; and, 851,770. U.S. Pat. Nos. 650,925, 542,564 and 109,318 all disclose cord bearing heads rotatably mounted on spindle-like handles. However, the disclosed devices are not suitable for solving the above described problems and have not been utilized by construction workers because of their inconvenience of use. None of the disclosed devices fits easily into the pocket or work apron of a construction worker due to various protrusions and extending edges. None has a cord bearing head which is substantially elongated in the direction of its axis of rotation. Hence, the disclosed devices must be carefully oriented so that the axis of rotation of the cord bearing head is very nearly perpendicular to the direction in which the cord or line is being dispensed in order to avoid snagging and/or tangling of the line being dispensed. This is especially true of the device shown in U.S. Pat. No. 109,318. The line reel of U.S. Pat. No. 542,564 is constructed of heavy wire, does not have an elongated cord-bearing head, and would not be suitable for being carried in a construction worker's pocket or work apron. The device is not easily grippable, is likely to snag the line being dispensed, and is generally unsuitable for constant use in the construction field.

There is clearly an unmet need for a cheap, rugged, safely and easily deployable construction line reel which can be conveniently and easily fitted into a construction worker's pocket and is yet capable of carrying lengths of construction line up to approximately 300 feet.

Accordingly, a further object of the invention is to provide a safely and conveniently deployable construction line dispensing apparatus which overcomes the shortcomings of the above mentioned prior art.

SUMMARY OF THE INVENTION

Briefly described, and in accordance with one embodiment thereof, the invention provides a construction line reel including a cord bearing head which is substantially elongated in the direction of its axis of rotation. The cord bearing head is rotatably disposed on an elongated handle aligned with the axis of rotation. The cord bearing head includes a generally flat elongated element of solid construction having a pair of symmetrically opposed wide notched disposed along the major sides thereof. The cord bearing head is rotatably disposed on an elongated handle aligned with the axis of rotation of the cord bearing head.

In the described embodiment of the invention, a notch is disposed in the cord bearing head for retaining the free end of construction line wound on the cord bearing head when not in use. The cord bearing head is of substantially solid construction, each of the grooves having a major surface parallel to the axis of rotation and a pair of end surfaces inclined toward the respective opposed minor ends of the cord bearing head.

DESCRIPTION OF THE INVENTION

Figure 1:
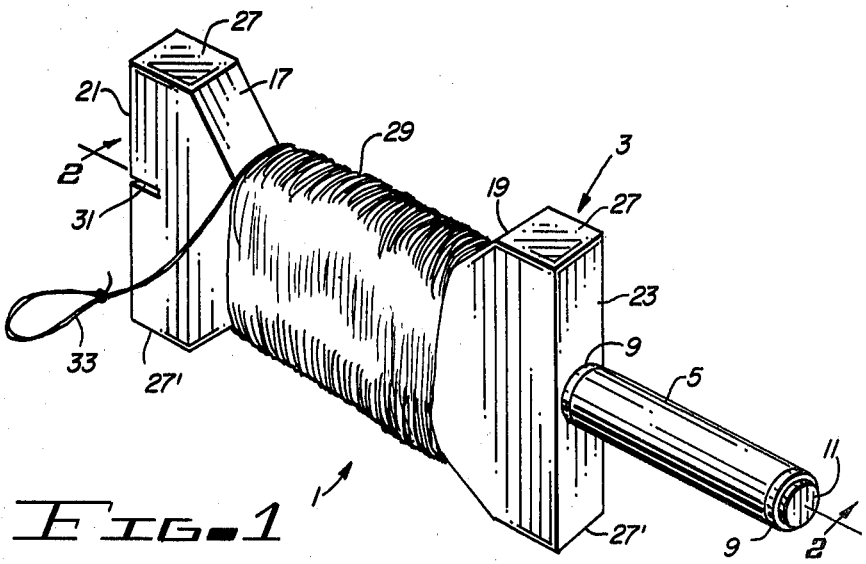
FIG. 1 is a perspective drawing of the construction line dispensing reel of the present invention with construction line wound thereon.
Figure 4:
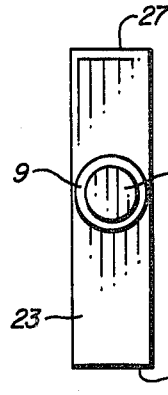
FIG. 4 is an end view of the handle end of the construction line dispensing reel of FIG. 2.
Figure 2:
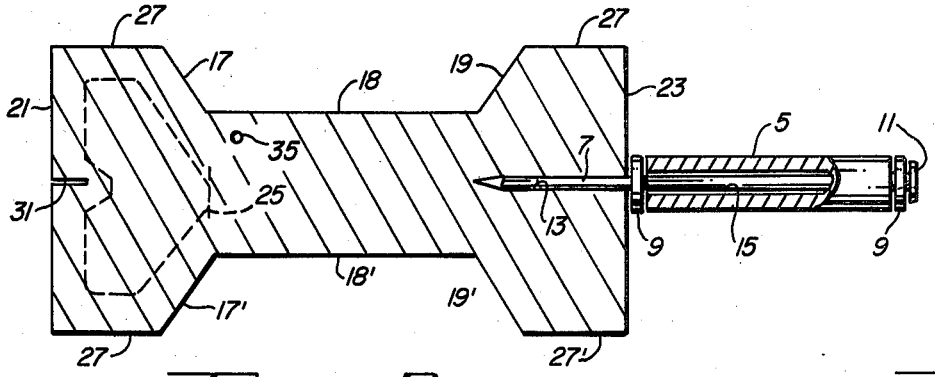
FIG. 2 is a side view of the construction line dispensing reel of FIG. 1 without the construction line.
Figure 5:
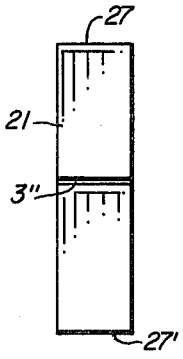
FIG. 5 is the opposite end view of the construction line dispensing reel of FIG. 4.
Figure 3:
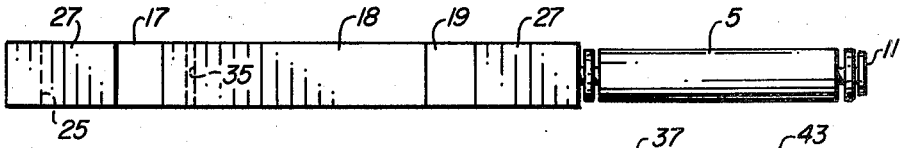
FIG. 3 is a top view of the construction line dispensing reel of FIG. 2.

Referring now to FIGS. 1 and 2, construction line reel 1 includes a cord bearing head 3 rotatably disposed on an elongated handle 5. Handle 5 is axially aligned with axis of rotation 6 of cord bearing head 3.

Cord bearing head 3 has a substantially elongated configuration having opposed parallel end surfaces 21 and 23. Cord bearing head 3 also has a pair of opposed side surfaces 27 and 27'. One side surface of cord bearing head 3 includes a pair of co-planar surface sections 27, a first inclined surface section 17 adjacent end 21, a second inclined surface 19 adjacent end 23. A surface section 18, parallel to axis 6, joins the inward ends of surface sections 17 and 19. Thus, a wide notch 17, 18, 19 is formed along one side of cord bearing head 3. A symmetrically opposed notch 17', 18', 19' is disposed along the opposite side of cord bearing head 3.

A narrow notch 31 is formed in end 21 of cord bearing head 3 for engaging the loose end 33 of construction line 29, as shown in FIG. 2.

A hole 35 (FIG. 2) in the body of cord bearing head 3 can be used for securely tying the inner end of construction line 29 to cord bearing head 3 to prevent slippage.

In the described embodiment of the invention, the distance between opposed ends 21 and 23 is approximately 6 inches, and the distance between opposed side surfaces 27 and 27' is approximately 3½ inches. The lateral extent of notch bottom surfaces 18 and 18' is approximately 3.5 inches and the perpendicular distance between the planes of surfaces 27 and 18 is approximately ¼ of an inch. These dimensions provide cord bearing head 3 with a suitable line carrying capacity for lengths for construction line up to approximately 300 feet, which is a length sufficient to satisfy the vast majority of uses for construction line.

The length of handle 5 is approximately 3.5 inches. Handle 5 has a cylindrical hole 15 therein through which a rigid shaft 7 extends. Shaft 7 extends and fits tightly into or is threaded into a hole 13 in cord bearing head 3. Handle 5 is loosely disposed on shaft 7, and is retained thereon by means of an enlarged head 11. A pair of washers 9 disposed on shaft 13 between handle 5 and end 23 and enlarged head 11 reduces friction between cord bearing head 3 and handle 5 as construction line is being dispensed.

Cord bearing head 3 may be constructed of solid wood or plastic material. If desired, sections of material of cord bearing head 3 can be eliminated to reduce weight, where such sections are not required for structural strength. For example, the section indicated by dotted line 25 could be removed.

Handle 5 can also be made of wood or plastic. Alternative materials for handle 5 and cord bearing head 3 include lightweight metals, such as aluminum. Numerous alternative structures could be provided for rotatably attaching handle 5 to line bearing head 3.

Figure 7:
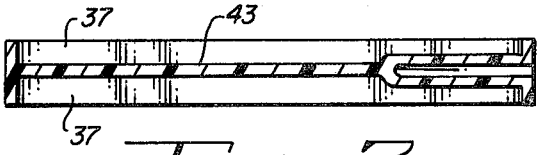
FIG. 7 is a section view taken along section lines 7—7 of FIG. 6.
Figure 8:
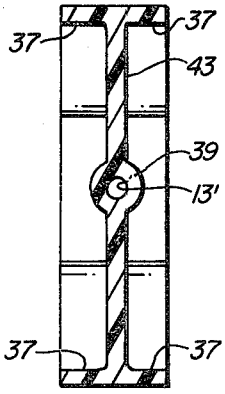
FIG. 8 is a section view taken along section lines 8—8 of FIG. 6.

An alternative configuration for the cord bearing head 3 described above, is shown in FIGS. 6–8. The disclosed configuration would be suitable for manufacture by injection molding processes. The general contour is the same as that shown in FIGS. 1 and 2 above. However, in the embodiments shown in FIGS. 6–8, a circumferential flange 37 is supported by a web 43. At the right hand end, a cylindrical section 39 includes therein a hole 13' for receiving shaft 7 for mounting handle 5. Notch 31' is disposed on the left hand end of cord bearing head 3 in FIG. 6 for engaging loose end 33 of construction line 29. Hole 35' can be utilized for tying the inner end of construction line 29 to cord bearing head 3 to prevent slippage.

Figure 6:
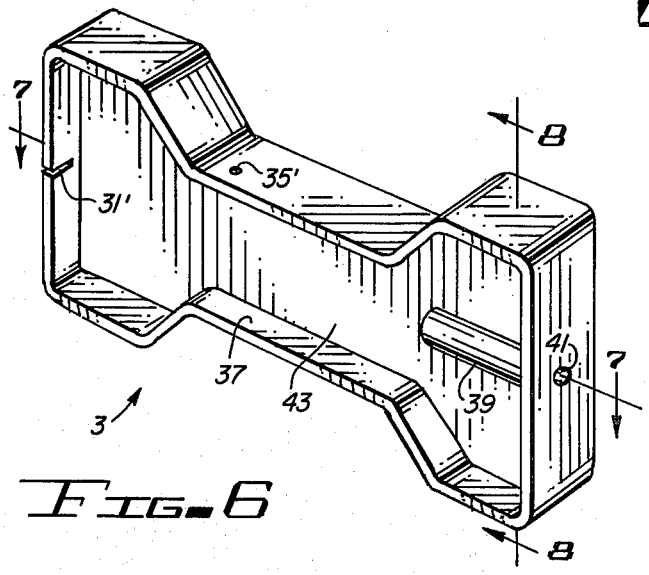
FIG. 6 is a partial perspective view of an alternative embodiment of the invention.

A substantial savings in plastic material is achieved using the design of FIG. 6 if injection molding techniques are utilized to manufacture the cord bearing head 3.

The described construction line reel can be very conveniently and safely utilized to dispense construction line by a construction worker with minimum attention directed to the process of dispensing construction line and maximum attention directed to use of his free hand to safely support himself. The above described construction line reel has the further advantage that construction line can be conveniently wound and unwound from the cord bearing head with minimum tangling and snagging of the construction line. This avoids the necessity for expensive loss of time taken for untangling construction line. Frequently, construction workers discard an entire spool of construction line which has become tangled rather than take the time required to untangle it. The necessity of having to locate another spool of construction line to replace one which has become hopelessly tangled is reduced by use of the above described construction line reel.

While the invention has been described with references to a particular embodiment thereof, those skilled in the art will be able to make various modifications to the described embodiment without departing from the true spirit and scope of the invention, as defined and set forth in the following claims.

We claim:

1. Apparatus for dispensing cord for use in conjunction with construction work, said apparatus comprising in combination:

a. an elongated handle to be held in a single hand of a construction worker during dispensing of cord from said apparatus, said handle having a first axis;

b. a substantially elongated cord bearing head rotatably mounted on said elongated handle, said cord bearing head including i. a second axis aligned with and parallel to the first axis of said elongated handle, said cord bearing head having a substantially rectangular cross-section to effect convenient insertion of said cord bearing head into a pocket of the construction worker and withdrawal of said cord bearing head from a pocket of the construction worker, said second axis being an axis of rotation of said cord bearing head, ii. first and second opposed parallel ends through which the axis of rotation passes, iii. first and second parallel opposed major faces extending between respective edges of said first and second opposed ends, and iv. first and second opposed side surfaces each extending between corresponding edges of said first and second major faces and said first and second ends, said first side surface having first and second substantially coplanar end portions, a first cord receiving notch being disposed between said first and second end portions, said first cord receiving notch having a first notch bottom surface parallel to said second axis, a first sloping surface extending between said first notch bottom surface and said first end portion, and a second sloping surface extending between said first notch bottom surface and said second end portion, said second side surface having third and fourth substantially coplanar end portions, a second cord receiving notch being disposed between said third and fourth end portions, said second cord receiving notch having a second notch bottom surface parallel to said second axis, a third sloping surface extending between said second notch bottom surface and said third end portion, and a fourth sloping surface extending between said second notch bottom surface and said fourth end portion, said first and second sloping surfaces sloping outwardly from said first notch bottom surface toward said first and second ends, respectively, said third and fourth sloping surfaces sloping outwardly from said second notch bottom surface toward said first and second ends, respectively;

c. bearing means for rotatably connecting said elongated handle to said second end; and d. notch means for retaining a loose end of cord wound on said cord bearing heads, the distance between said first and second end being equal to a first distance, the lengths of said first and second notch bottom surfaces being equal to a second distance, said first distance being substantially greater than said second distance, the second distance being substantially greater than a third distance between said first and second major faces, said first, second and third distances being selected to enable said cord bearing head both to be easily inserted into and withdrawn from a pocket of the construction worker and to enable an approximately 200 foot length of construction cord to be conveniently wound on said cord bearing head so that loops of the wound construction cord do not extend substantially outwardly of said first, second, third and fourth end portions, thereby preventing loops of wound construction cord from slipping laterally off of said cord bearing head, said cord bearing head having no protrusions therefrom which can interfere with inserting said cord bearing head into a construction worker's pocket or withdrawing said cord bearing head from a construction worker's pocket, whereby a worker can safely and conveniently carry and deploy said apparatus to dispense construction cord using only one hand with little attention being focused on orientation of said apparatus during the dispensing.

2. The apparatus of claim 1 wherein said first and second ends are substantially perpendicular to said axis of rotation.

3. The apparatus of claim 2 wherein said notch means includes a notch in said first end, said notch being of sufficient depth and width to securely engage the loose end, yet permitting easy engagement of the loose end in said notch and easy removal of the loose end from the notch.

4. The apparatus of claim 1 wherein said elongated handle includes a cylindrical hole aligned with the axis of said elongated handle, wherein said bearing means includes a cylindrical shaft rigidly engaged with said cord bearing head and extending through said cylindrical hole so that said cord bearing head is freely rotatable with respect to said elongated handle.

5. The apparatus of claim 4 wherein said cord bearing head is composed of wood.

6. The apparatus of claim 4 wherein said cord bearing head is composed of plastic.

* * * * *